US008732908B2

(12) United States Patent
Hatano

(10) Patent No.: US 8,732,908 B2
(45) Date of Patent: May 27, 2014

(54) HINGE WITH TORQUE SETTING FUNCTION

(75) Inventor: Yuuichi Hatano, Chiyoda-ku (JP)

(73) Assignee: Sugatsune Kogyo Co., Ltd., Chiyoda-Ku (JP)

( * ) Notice: Subject to any disclaimer, the term of this patent is extended or adjusted under 35 U.S.C. 154(b) by 26 days.

(21) Appl. No.: 13/578,535

(22) PCT Filed: Feb. 10, 2011

(86) PCT No.: PCT/JP2011/052857
§ 371 (c)(1),
(2), (4) Date: Oct. 3, 2012

(87) PCT Pub. No.: WO2011/099556
PCT Pub. Date: Aug. 18, 2011

(65) Prior Publication Data

US 2013/0117967 A1 May 16, 2013

(30) Foreign Application Priority Data

Feb. 12, 2010 (JP) ..... 2010-028707

(51) Int. Cl.
*E05C 17/64* (2006.01)
*E05D 11/08* (2006.01)

(52) U.S. Cl.
USPC ..... 16/342

(58) Field of Classification Search
USPC ..... 16/342, 337, 338, 339, 252, 386, 387
See application file for complete search history.

(56) References Cited

U.S. PATENT DOCUMENTS

| | | | | | |
|---|---|---|---|---|---|
| 645,218 | A | * | 3/1900 | Roche | 16/338 |
| 1,638,065 | A | * | 8/1927 | Simon | 16/338 |
| 2,582,584 | A | * | 1/1952 | Carbiener | 49/391 |
| 2,682,229 | A | * | 6/1954 | Luenberger | 417/414 |
| 2,929,093 | A | * | 3/1960 | Conlee | 16/338 |
| 4,630,333 | A | * | 12/1986 | Vickers | 16/338 |
| 5,598,607 | A | * | 2/1997 | Katagiri | 16/337 |
| 5,682,645 | A | * | 11/1997 | Watabe et al. | 16/338 |

(Continued)

FOREIGN PATENT DOCUMENTS

| | | | |
|---|---|---|---|
| DE | 19838820 | A1 * | 3/2000 |
| JP | 07-103225 | A | 4/1995 |

(Continued)

OTHER PUBLICATIONS

Microfilm of the specification and drawings annexed to the request of Japanese Utility Model Application No. 110092/1983 (Laid-open No. 19666/1985) (Kabushiki Kaisha Ota Seisakusho), Feb. 9, 1985.

*Primary Examiner* — Chuck Mah
(74) *Attorney, Agent, or Firm* — Pearne & Gordon LLP

(57) ABSTRACT

There is provided a hinge with torque setting function for connecting two objects by a hinge shaft adapted to be assembled with precision and to be tightened easily. In order to reduce the diameter of the curvature portion 42 of the holder 40 through the brake member 30 on the hinge shaft 20, there is attached by the screw the adjusting member 46 which can vertically move within the latch portions (vertical grooves) 42G of the curvature portion 42 individually from an angular movement of the curvature portion 42 when it is tightened. The screw 5 can be tightened by vertical movement thereof without being restrained by the angular movement of the curvature portion 42 and therefore, the tightening of the holder 40 can be carried out with high precision and effectiveness of operation.

9 Claims, 12 Drawing Sheets

(56) References Cited

U.S. PATENT DOCUMENTS

| | | | | | |
|---|---|---|---|---|---|
| 5,771,540 | A | * | 6/1998 | Carpenter et al. | 16/308 |
| 6,085,388 | A | * | 7/2000 | Kaneko | 16/338 |
| 7,404,234 | B2 | * | 7/2008 | Lee et al. | 16/322 |
| 7,472,459 | B2 | * | 1/2009 | Lee et al. | 16/342 |
| 2008/0184527 | A1 | * | 8/2008 | Chao | 16/221 |

FOREIGN PATENT DOCUMENTS

| | | | | |
|---|---|---|---|---|
| JP | 09-217545 | A | | 8/1997 |
| JP | 11062361 | A | * | 3/1999 |
| JP | 2000-136819 | A | | 5/2000 |
| JP | 2001-241427 | A | | 9/2001 |
| JP | 2001-279989 | A | | 10/2001 |

* cited by examiner

HINGE WITH TORQUE SETTING FUNCTION

TECHNICAL FIELD

This invention relates to an improvement on a hinge with torque setting function adapted to be able to set up torque to impart a resistance to a pivotal movement of various pivotally moving objects such as a lid of a case when the pivotally moving objects are pivotally supported on a fixed object.

BACKGROUND OF TECHNOLOGY

In order to hold the various pivotally moving objects such as a liquid crystal display of a notebook personal computer or a hinge opening/closing type lid of a container at a predetermined pivotal position, there have been used various hinges with torque setting function and one example thereof is disclosed in Patent Document 1.

The hinge disclosed in the Patent Document 1 is provided with a hinge shaft to pivotally support the pivotally moving object on the fixed object, a plastic braking member in the form of slit cylinder to closely engage the hinge shaft and a holder attached to the brake member to hold the hinge shaft while forcing the brake member against the hinge shaft with predetermined pressure. As shown in FIGS. 3, 6 and 7 of Patent Document 1, this holder has a curvature portion to embrace the hinge shaft through the brake member and both-end flat tightening portions integrally extending from the curvature portion and fixed by screws to the wall face of the pivotally moving object. The pressure under which the brake member is forced against the hinge shaft is set by adjusting the tightening strength of the flat tightening portions.

With such a structure, the curvature portion is expanded and contracted in order to insert the hinge shaft into the curvature portion of the holder so as to embrace the hinge shaft in the holder, but since at least one of the both-end flat tightening portions integrally extending from the curvature portion angularly moves with the expanding and contracting movement of the curvature portion, a screw penetrating through and tightened to the one end flat tightening portion will also angularly moves when tightened. Thus, since the screw cannot enter into a threaded hole in alignment therewith when tightened, it needs to penetrate through an elongated hole etc. whereby it can move horizontally relative to the flat tightening portion. However, it is difficult to tighten the screw into the threaded hole while it moves horizontally within the elongated hole and therefore the holder cannot disadvantageously be tightened with high precision. Especially, in case where a caulking pin is used instead of the screw for tightening the holder, the caulking pin cannot tighten the holder while it moves within the elongated hole and therefore the holder cannot be tightened by caulking.

PRIOR ART LITERATURES

Patent Document

[Patent Document 1] JP7-103225A (1995)

SUMMARY OF THE INVENTION

Problems to be Solved by the Invention

A problem to be solved by the invention is to provide a hinge with torque setting function adapted to tighten a holder by either of a screw or a caulking pin with precision and easily.

Means to Solve the Problems

Means to solve the problems according to one form of the invention is to provide a hinge with torque setting function comprising a hinge shaft to pivotally support two objects and securely attached through an attachment portion to one of said objects (referred to as first object later), a brake member closely engaging said hinge shaft and a holder securely attached to the other of said objects (referred to as second object later), having said brake member secured thereto and holding said hinge shaft while forcing said brake member against said hinge shaft under predetermined pressure, said holder including a curvature portion to embrace said hinge shaft through said brake member and serving to tighten said curvature portion to said first or second object or a member to be attached to said first or second object (referred to as object etc, later) so as to reduce a diameter of said curvature portion, characterized in that said holder includes an adjusting member separate from said curvature portion, said adjusting member serving to tighten said curvature portion so as to reduce the diameter of said curvature while moving individually from an angular movement of said curvature portion when the diameter of said curvature portion is reduced.

Means to solve the problems according to another form of the invention is to provide a hinge with torque setting function comprising a hinge shaft to pivotally support two objects and securely attached through an attachment portion to one of said objects (referred to as "first object" later) and a holder including a curvature portion closely engaging said hinge shaft, said holder securely attached to the other of said objects (referred to as "second object" later) and holding said hinge shaft while forcing said curvature against said hinge shaft under predetermined pressure, said holder serving to tighten said curvature portion to said first or second object or a member to be attached to said first or second object (referred to as "object etc. later) while reducing a diameter of said curvature portion, characterized in that said holder includes an adjusting member separate from said curvature portion, said adjusting member serving to tighten said curvature portion so as to reduce the diameter of said curvature while moving individually from an angular movement of said curvature portion when the diameter of said curvature portion is reduced.

In the two above-mentioned means to solve the problems of the invention, said holder may include a flat tightening portion extending from an end of said curvature portion to be fixed to said object etc, and said adjusting member may be in the form of tightening said flat tightening portion so as to reduce a diameter of said curvature portion by being engaged with a latch portion provided on another end of said curvature portion in a direction parallel to said flat tightening portion.

In the means to solve the problems of the invention, another end of said curvature portion may have at least one insertion piece inserted into a thrusting groove in said flat tightening portion and said latch portion may be in the form of being provided on said insertion piece.

In the means to solve the problems of the invention, said flat tightening portion may be one of fastening boards to be attached to said first or second object by a screw and another fastening board to be attached to said first or second object by the screw may be in the form of being attached to said hinge shaft o as to rotate together with said hinge shaft.

Effect of the Invention

According to the invention, since the function of reducing the diameter of the curvature portion of the holder is carried out by screwing or caulking the adjusting member which is provided separately from the curvature portion and which can move vertically within the latch portion of the curvature portion individually from the angular movement of the curvature portion when it is tightened, the screw or the caulking pin can tighten the curvature portion through the perpendicular movement thereof without being limited, by the angular movement of the curvature portion and therefore, the tightening of the holder can be made with high precision and effectiveness of the operation.

BRIEF DESCRIPTION OF THE DRAWINGS

FIG. 1 illustrates a hinge with torque setting function according to one form of embodiment of the invention wherein FIGS. 1(A) through 1(E) are a perspective view, a plane view, cross sectional views taken along a C-C line, a D-D line and E-E line of FIG. 1(B), respectively;

FIG. 3 is a perspective view sequentially showing assembling the hinge with torque setting function of FIG. 1 wherein FIG. 3(A) illustrates a state before an adjusting member of a holder is attached; FIG. 3(B) illustrates a state where the adjusting member is engaged into the curvature portion, FIG. 3(C) illustrates a state where a caulking pin penetrates through the adjusting member and the flat tightening portion, but before it does not caulk them;

FIG. 4 is a top view sequentially showing assembling the hinge with torque setting function of FIG. 1 in the same manner as FIG. 3 wherein FIGS. 4(A) through 4(C) show the same states as FIGS. 3(A) through 3(C), respectively;

FIG. 5 sequentially shows assembling the hinge with torque setting function of FIG. 1 in the same manner as FIGS. 3 and 4 wherein FIGS. 5(A) through 5(C) are cross sectional views taken along lines 5-5 of FIGS. 4(A) through 4(C), respectively;

FIG. 6 sequentially shows assembling the hinge with torque setting function of FIG. 1 in the same manner as FIGS. 3 and 4 wherein FIGS. 6(A) through 6(C) are cross sectional views taken along lines 6-6 of FIGS. 4(A) through 4(C), respectively;

FIG. 7 illustrates a hinge with torque setting function according to another form of embodiment of the invention wherein FIG. 7(A) is a perspective view of the hinge with torque setting function, FIG. 7(B) is a cross sectional view taken along B-B line thereof and FIG. 7(C) is a perspective view of the hinge with torque setting function before tightened by a screw;

FIG. 8 illustrates a hinge with torque setting function according to further form of embodiment of the invention wherein FIG. 8(A) is a perspective view of the hinge with torque setting function, FIG. 8(B) is a cross sectional view taken along B-B line thereof and FIG. 8(C) is a perspective view of the hinge with torque setting function before tightened by a screw and a nut;

FIG. 10 illustrate a hinge with torque setting function according to further embodiment of the invention wherein FIG. 10(A) is an explosively perspective view thereof and FIG. 10(B) is a cross sectional view of a portion having a tightening member in the state of assembly;

MODE OF EMBODIMENT OF THE INVENTION

Figure 11:
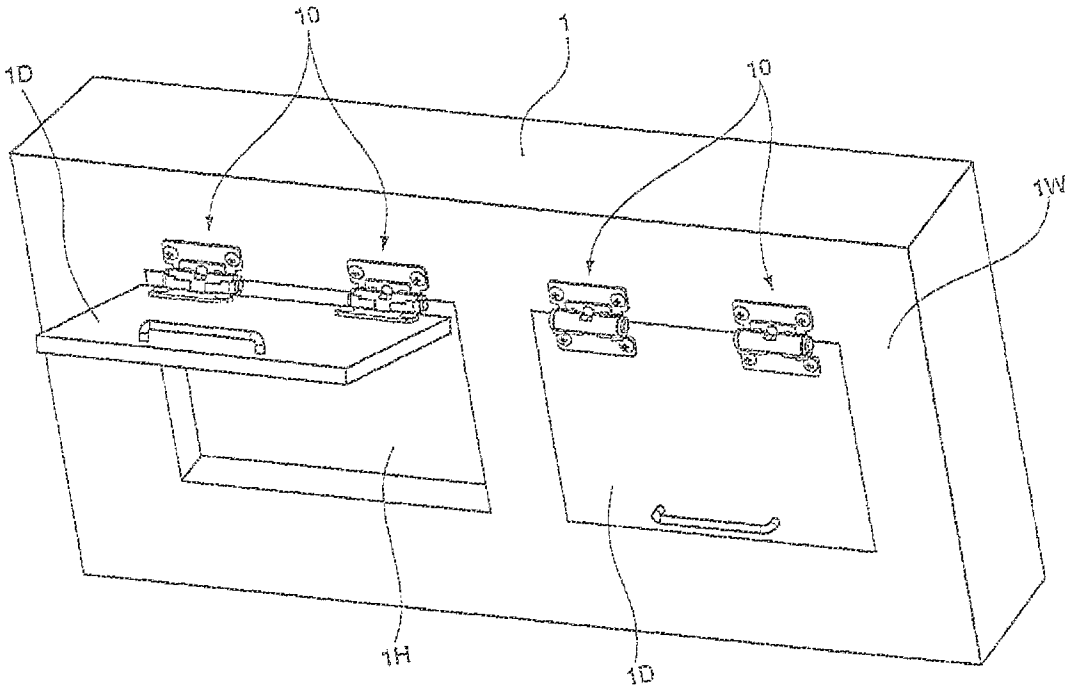
FIG. 11 is a perspective view of the hinge with torque setting function of the invention in one state of use thereof.
Figure 12:
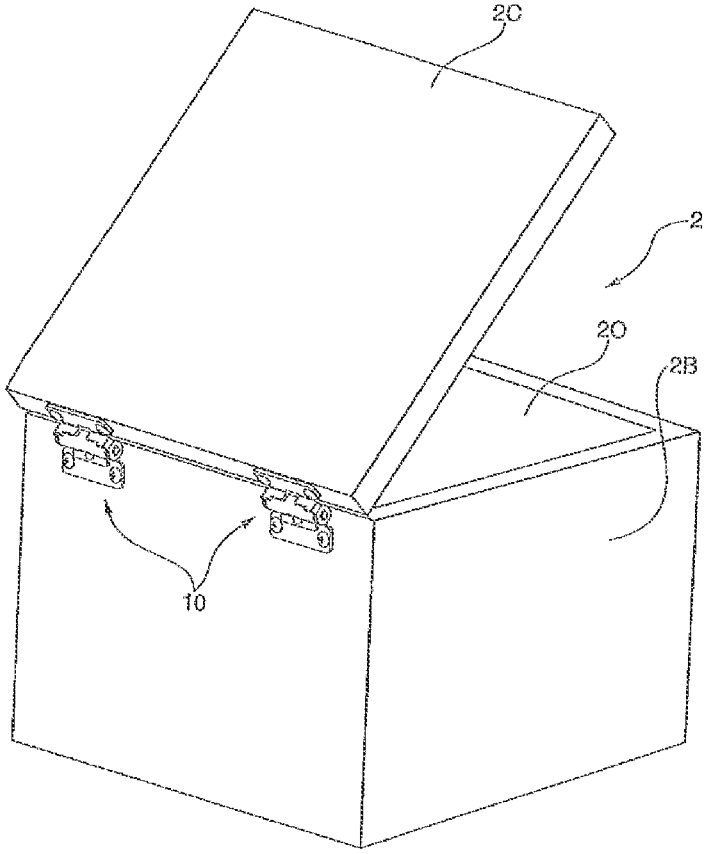
FIG. 12 is a perspective view of the hinge with torque setting function of the invention in another state of use.

A hinge 10 with torque setting function according to a form of embodiment of the invention will be described in detail below with reference to FIGS. 1 through 8. This hinge 10 with torque setting function may be used for pivotally supporting a door 1D to open and close a window hole 1H provided in a wall 1W of a building 1 and the like on the wall 1W as shown in FIG. 11 or for pivotally supporting a lid 2C to open and close an opening 2O of a case 2 to a case body 2B as shown in FIG. 12, but it is not limited for the hinge to be used to these and it may be used for pivotally bonding other various two objects (referred to as a first object and a second object later).

The hinge 10 with torque setting function according to one embodiment of the invention is shown in FIGS. 1 through 6 and the hinge 10 with torque setting function comprises a hinge shaft 20 to pivotally bond the first and second objects with each other, a brake member 30 in the form of slit cylinder closely engaging the hinge shaft 20 and a holder 40 having the brake member 30 secured thereto and holding the hinge shaft 20 while forcing the brake member 30 against the hinge shaft 20 under predetermined pressure.

Figure 2:
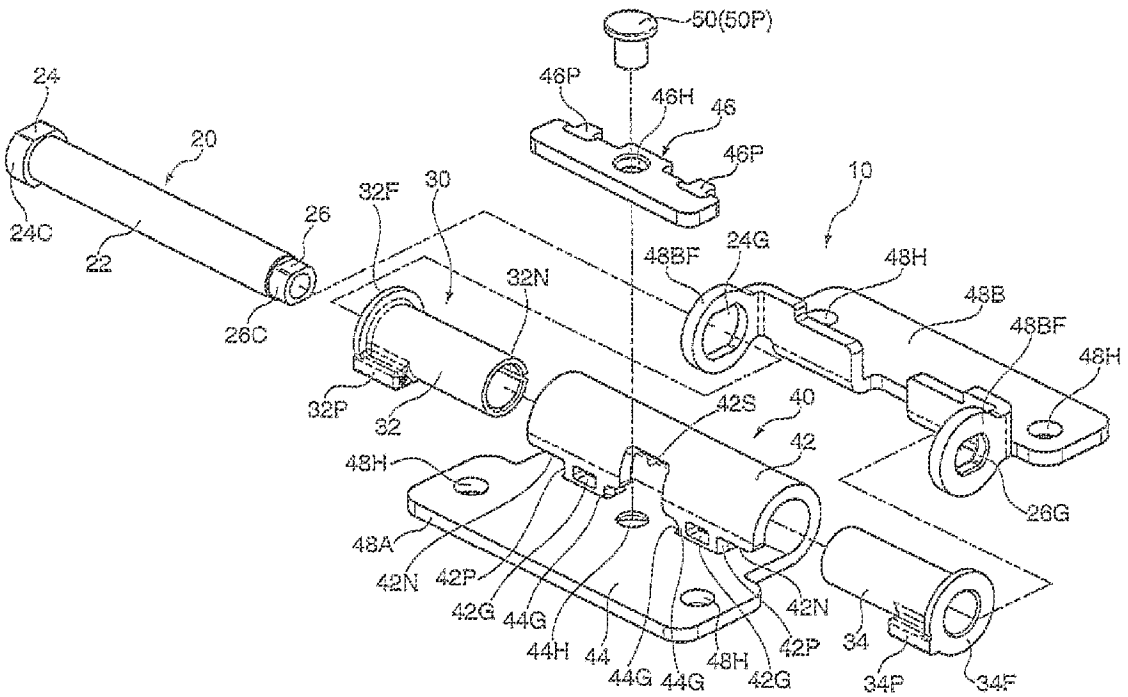
FIG. 2 is an exploded perspective view of the hinge with torque setting function of FIG. 1.
Figure 3:
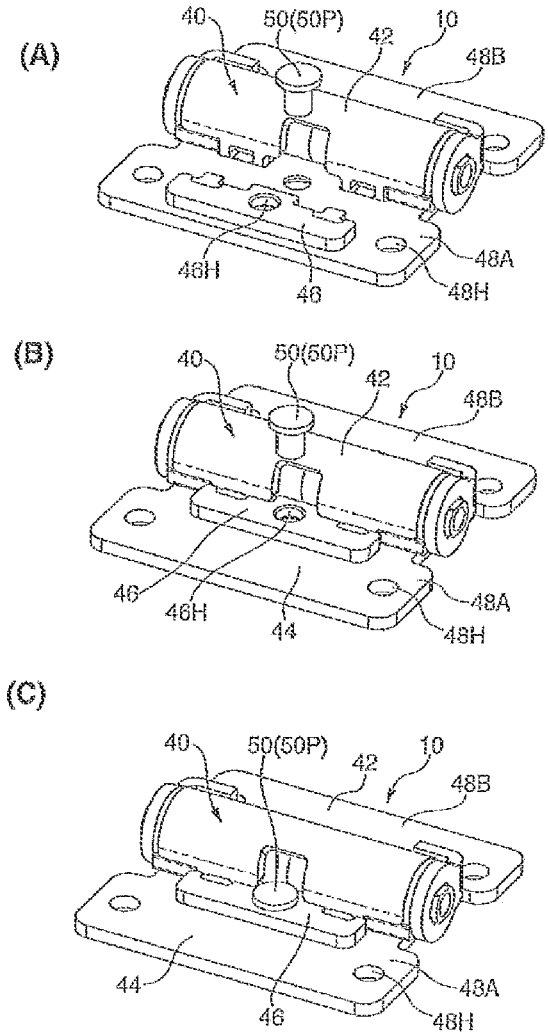
Figure 4:
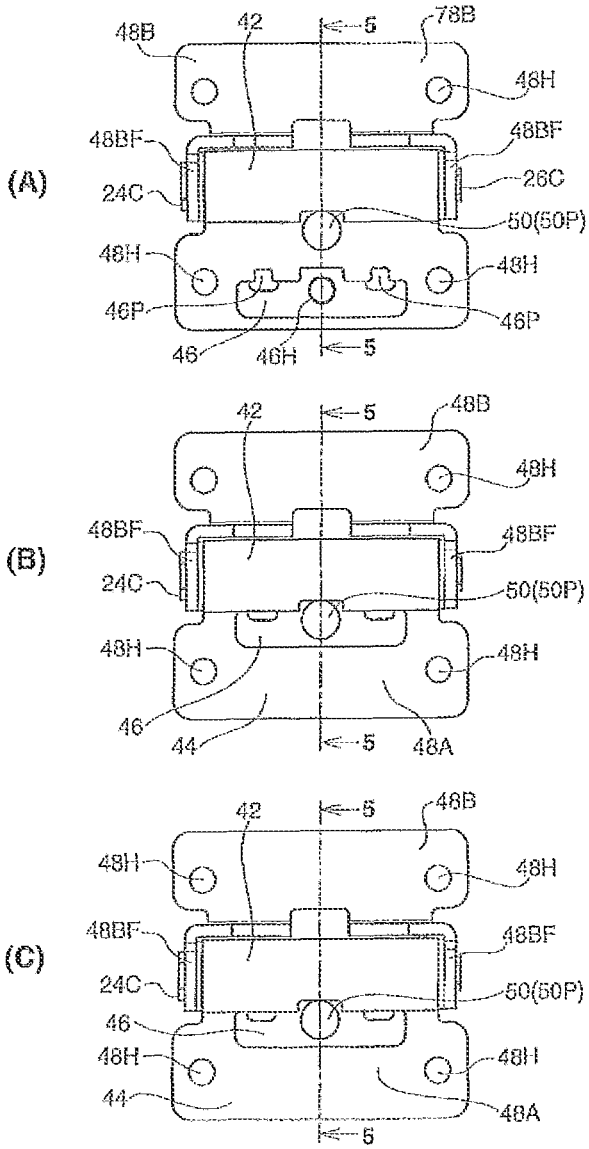
Figure 5:
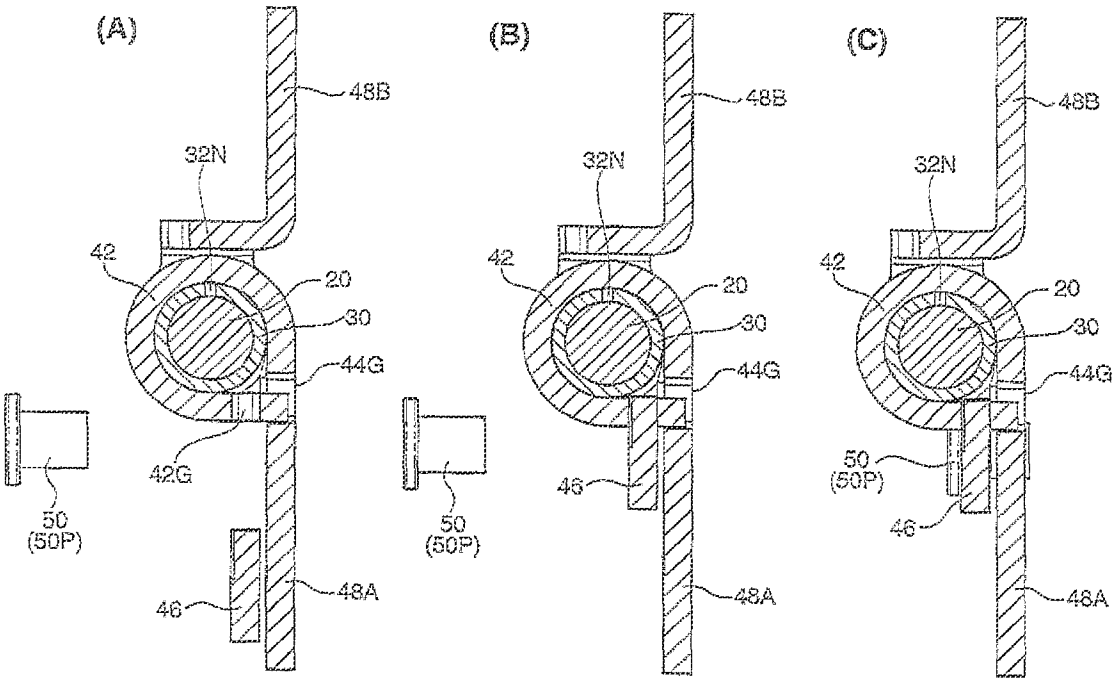

The hinge shaft 20 has partial square-shaped ends 24 and 96 on both ends of a pillar or cylindrical shaft body 22 as shown in FIG. 2. One partial square-shaped end 24 has a cylindrical portion 24C of a diameter larger than that of the shaft body 22 while another partial square-shaped end 26 has a cylindrical portion 26C of a diameter smaller than that of the shaft body 22. This hinge shaft 20 may be made of metal, plastic or any other hard material. The square-shaped ends 24 and 26 are used for attaching the hinge shaft 20 to a second fastening board to be attached to one of the first and second objects (referred to as a second object later) as described in more details later.

As shown in FIG. 2, the brake member 30 includes two cylindrical portions 32 and 34 axially divided from each other and these cylindrical portions 82 and 34 have slits 32N and 34N (see FIG. 1(C)) in the longitudinal direction and flanges 32F and 34F on the opposite end thereof, respectively. The diameter of these cylindrical portions 34 and 36 is adapted to be able to be reduced due to the slits 32N and 34N, respectively except for the portion closed by the flanges 32F and 34F. The brake member 30 may be made of high frictional material such as plastic.

As shown in FIGS. 1(C), 1(D) and FIG. 2, the holder 40 comprises a curvature portion 42 for embracing the hinge shaft 20 through the brake member 30, a flat tightening portion 44 integrally extending from one end of the curvature portion 42 to be fixed to the first object and an adjusting member 46 to be loosely engaged with a latch portion 42G provided on the other end of the curvature portion 42 from a direction parallel to the flat tightening portion 44. The adjusting member 46 is attached by screwing or a caulking to the flat tightening portion 44 so that, the diameter of the curvature portion 42 is reduced, but the details thereof will be explained later with reference to FIGS. 5 and 6. In the illustrated form, the latch portion 42G may be in the form of vertical slot, but it may be in the form of two opposing hook protrusion pieces or in any arbitrary form so long as the free end of the curvature portion 42 can be forced so that the adjusting member 46 can reduce the diameter of the curvature portion 42. In the illustrated form, the latch portion 42 includes two vertical grooves, but it may include one vertical groove of larger width formed at the middle of the curvature portion 42 (this may be applied to a pair of hook protrusion pieces, for example instead of the grooves).

In the illustrated form, the curvature portion 42 has two insertion pieces at its free end and these two insertion pieces 42P are inserted into insertion grooves 44G provided in the flat tightening portion 44 so as to be able to move in an upward and downward direction. The two vertical grooves of the latch portion 42G are formed in the two insertion pieces 42P, respectively so that they are exposed to the upper face of the flat tightening portion 44, in case where the latch portion 42G is singular, there may be used the single insertion piece 42P.

Figure 1:
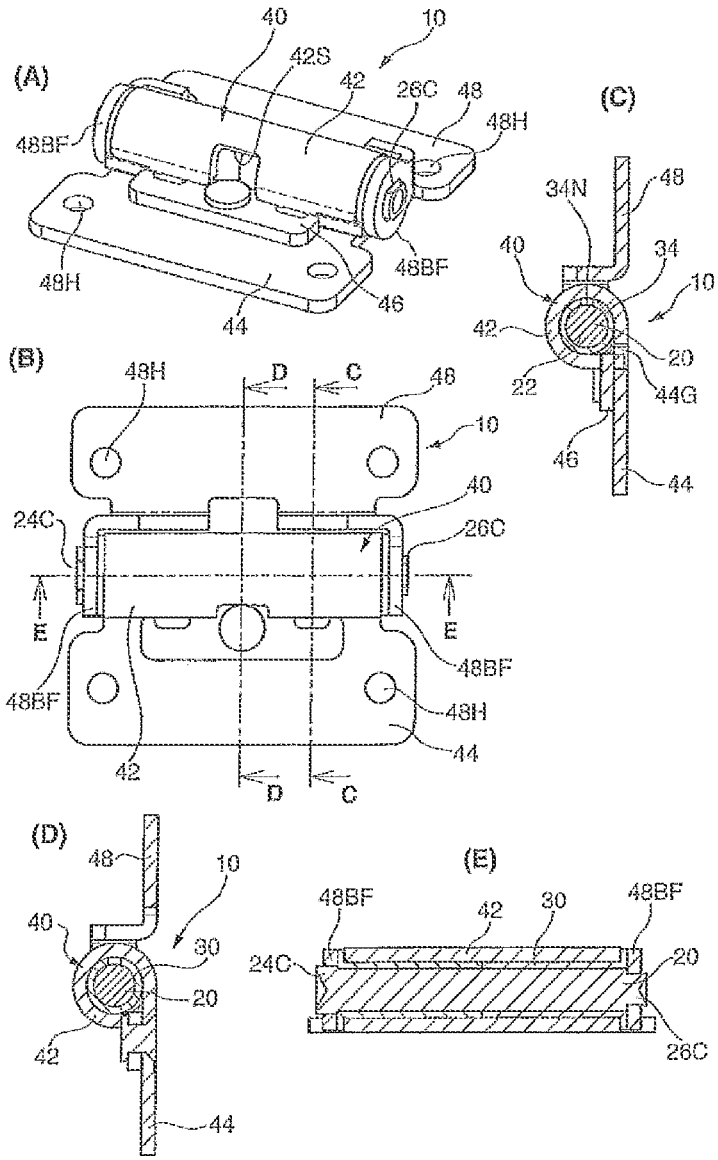

In the illustrated form, the flat tightening portion 44 has a fastening board 48A formed thereon to be attached to the first object and another fastening hoard or mounting portion) 48B to be attached by screwing to the second object which should be in turn pivotally attached to the first object is attached to the hinge shaft 20 so that it rotates together with the hinge shaft 20. More particularly, the fastening board 48B has two end flanges 48BF provided with square-shaped holes 24G to be engaged with the square-shaped ends 24 and 26 of the hinge shaft 20, respectively and the fastening board 48B is attached to the hinge shaft 20 so that it rotates with the hinge shaft 20 by engagement of its square-shaped ends 24 and 26 into the square-shaped holes 24G and 26G of the flanges 48BF. The reason why the square-shaped ends 24 and 26 have large and small cylindrical portions 24C and 26C of different diameters is to allow the hinge shaft 20 to be sequentially inserted into the square-shaped holes 24G and 26G of the fastening board 48B from the side of the square-shaped end 26 having the cylindrical portion 26C of smaller diameter. In FIGS. 1 and 2, reference numeral 48H designate screw penetration holes used for screwing the fastening boards 48A and 48B to the first and second objects that should be pivotally bonded to each other, respectively.

The brake member 30 has protrusions 32P and 34P provided on its cylindrical portions to be engaged into an inverted L-shaped notches 42N in both ends of the curvature portion 42 of the holder 40 and therefore, the brake member 30 is integral with the holder 40 in the rotational direction by the engagement of the protrusions 32P and 34P into the notches 42N and can relatively rotate together with the holder 40 relative to the hinge shaft 20.

As shown in FIG. 2, the adjusting member 46 has protrusion pieces 46P to be engaged with the latch portion 42G (in the illustrated form of vertical grooves) provided in one end (free end) of the curvature portion 42 of the holder 40. The adjusting member 46 can reduce the diameter of the curvature portion 42 by tightening the adjusting member 46 onto the flat tightening portion 44 in the state where the protrusion pieces 46P is engaged with the latch portions 42G of the curvature portion 42 so as to fasten the protrusion pieces 46P to the latch portions 42G of the curvature portion 42 whereby the free end of the curvature portion 42 is pulled. In order to allow the protrusion piece 46P of the adjusting member 46 to vertically move without any restraint by angular movement (movement of the free end of the curvature portion 42 in the direction where the diameter of the curvature portion 42 is reduced) within the latch portions 42G, it is necessary that there is a gap between the protrusion pieces 46P and the latch portions 42G (see FIGS. 5(A) through (C) and FIG. 10(B)).

As already described, in the illustrated form, since the latch portion 42G comprises two vertical grooves, the adjusting member 46 also has two protrusion pieces 46P corresponding to those vertical grooves.

The adjusting member 46 and the flat tightening portion 44 have tightening holes 46H and 44H, respectively, which are aligned with each other in the state where the adjusting member 46 is engaged into the latch portion 42G of the curvature portion 42 so as to be engaged therewith. A tightening member 50 penetrates through the tightening holes 46H and 44H and is tightened so that the adjusting member 46 and the flat tightening portion 44 get closely engaged with each other. The curvature portion 42 may have a notch-like escape 42S so that the tightening member 50 does not interfere with the curvature portion 42 when it is tightened.

In the form of embodiment of FIGS. 1 through 6, the tightening member 50 in the form of caulking pin 50P may be used in order to tighten the adjusting member 46 to the flat tightening portion 44. A method for assembling the hinge 10 with torque setting function according to the form of FIGS. 1 through 8 will be explained in details below with reference to FIGS. 3 through 6.

The hinge 10 with torque setting function in the form of FIGS. 1 through 6 is assembled so that the brake member 30 and the curvature portion 42 of the holder 40 are sequentially superposed one in another around the hinge shaft 20 as shown in (A) of FIGS. 3 through 6 before torque is setup. In this state, the curvature portion 42 of the holder 40 does not act so that the brake member 30 is forced on the hinge shaft 20.

From this state, as shown in (B) of FIGS. 3 through 6, the adjusting member 46 is attached to the curvature portion 42 so that the adjusting member 46 of the holder 40 is engaged with the curvature portion 42. This attachment is carried out by engaging the protrusion pieces 46P of the adjusting member 46 into the vertical grooves of the latch portion 42G of the curvature portion 42.

Figure 6:
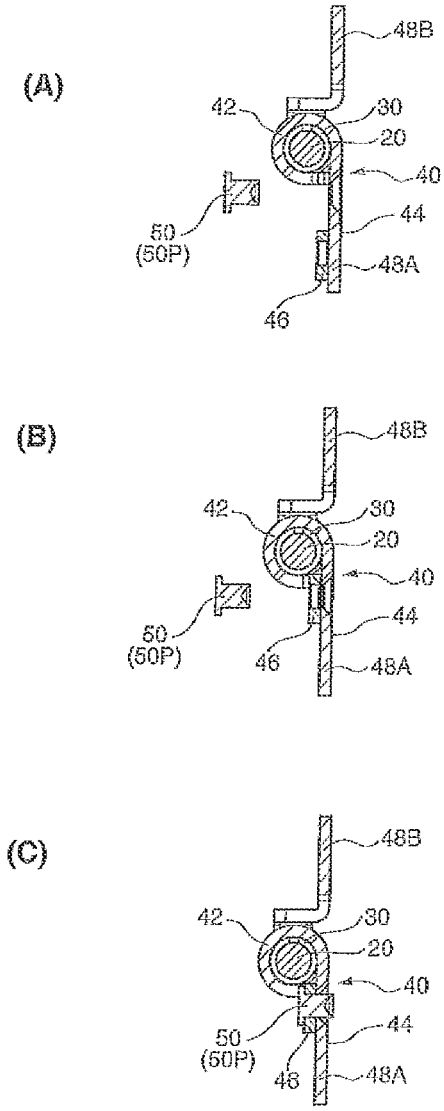
Figure 8:
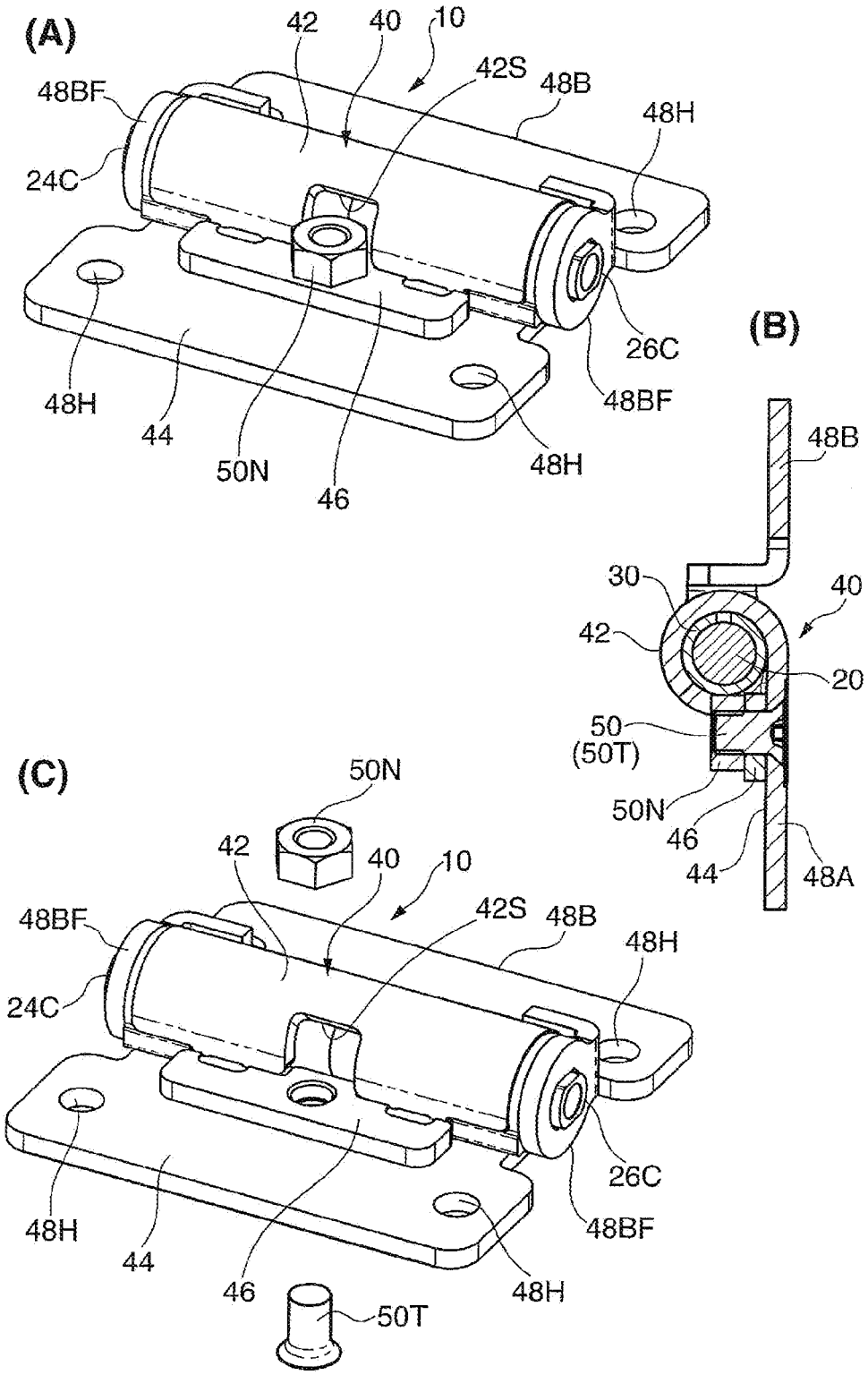

Thereafter, as shown in (C) of FIGS. 8 through 6, the caulking pin 50P penetrates through the tightening hole 44H and caulks the lower end of the caulking pin 50P to tight the adjusting member 46 to the flat tightening portion 44 under predetermined pressure as shown in FIGS. 1(A) through 1(E) whereby the curvature portion 42 of the holder 40 forces the brake member 30 onto the hinge shaft 20 with predetermined torque.

It should be noted that when the curvature portion 42 of the holder 40 tightens the brake member 30 onto the hinge shaft 20, the free end of the curvature portion 42 is pushed by the adjusting member 46 to move in a direction where it is wound around the hinge shaft 20, but the protrusion piece 46P of the adjusting member 46 engaged with the free end of the curvature portion 42 to reduce the diameter of the curvature portion 42 is loosely engaged within the vertical grooves of the latch portions 42G and therefore, the tightening member 50 can vertically move without any restraint thereof due to the angular movement of the curvature portion 42 to thereby reduce the diameter of the curvature portion 42. Thus, the tightening (caulking) of the tightening member 50 may be carried out with high precision and effectiveness of the operation.

Figure 7:
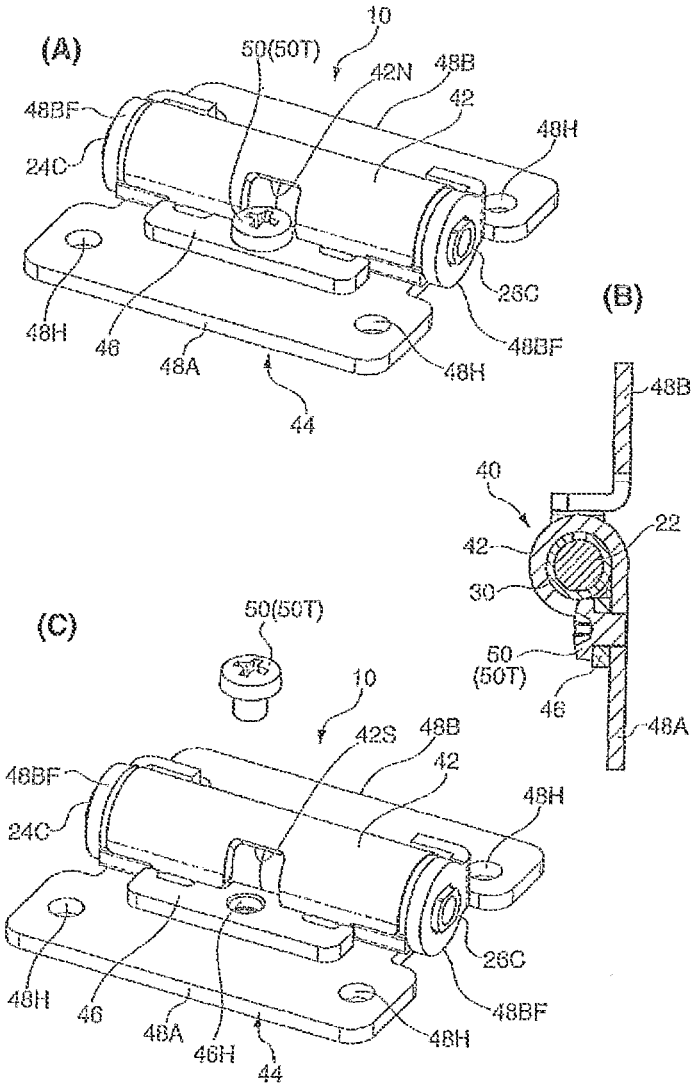

Other forms of embodiment of the invention are shown in FIGS. 7 and 8 and in these forms of embodiment, a screw-like tightening member 50 is used in place of the caulking member 50P of the forms of embodiment of FIGS. 1 through 6. More particularly, in the form of embodiment of FIG. 7, the tightening member 50 comprises a tightening screw 50T which penetrates through the tightening hole 44H and is engaged into the tightening hole (threaded hole) in the flat tightening portion 44 whereby the adjusting member 46 is tightened onto the flat tightening portion 44. In the form of embodiment of FIG. 8, the tightening member 50 comprises a screw 50T which penetrates through the tightening hole 44H of the flat tightening portion 44 and the tightening hole 46H of the adjusting member 46 from the underside and a nut 50N disposed on the upper side of the adjusting member 46 so that the screw 50T is threaded into the nut 50N. In either form of embodiment, torque pressure is set up by the quantity of threaded engagement of the screw 50T. In these forms of embodiment, the tightening of the screw 50T may be carried out with high precision and effectiveness of the operation without any restraint caused by the angular movement of the curvature portion 42.

Figure 9:
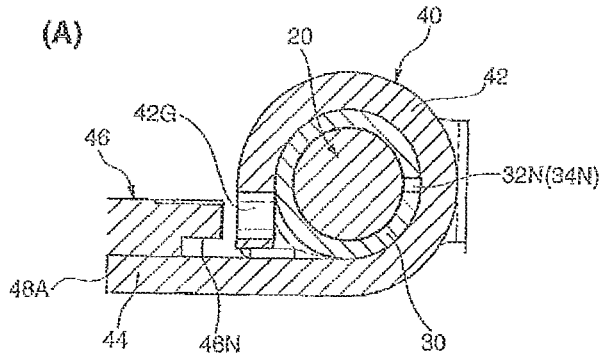
FIG. 9 is a cross sectional view showing a modification of the holder of the hinge with torque setting function of the invention.
Figure 9:
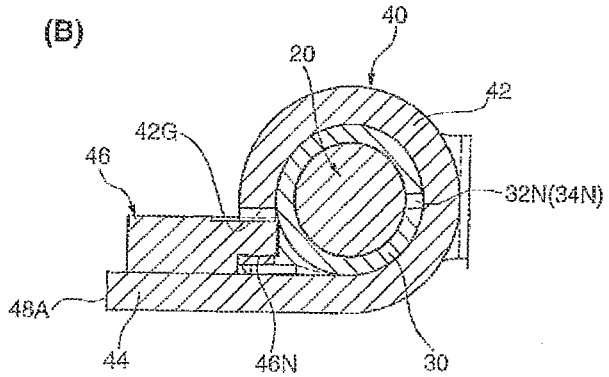

A modification of the invention is shown in FIG. 9 and in this modification, the curvature portion 42 of the holder 40 is the same as the forms of embodiment of FIGS. 1 through 8 except for the curvature portion 42 of the holder 40 having no insertion piece 42P provided thereon. In this case, the protrusion pieces 46P of the adjusting member 46 have an inverted-L shaped notch 46N in the underside of the leading end thereof. The leading end 46T with the notch 46N is engaged into the latch portions 42G of the curvature portion 42 whereby the adjusting member 46 is engaged therewith and fastened thereto. As the tightening member 50 tights the adjusting member 46 to the flat tightening portion 44, the leading end 46T with the notch 46N tights the free end of the curvature portion 42 through the latch portion 42G in the direction where the diameter thereof is reduced.

Although, in the forms of embodiment of FIGS. 1 through 9, the brake member 30 has the notches 32N and 34N in a longitudinal direction and imparts the brake torque to the hinge shaft 20 by contracting these notches, there may be required no notch so long as the brake member 30 can impart the pressure to the hinge shaft 20 by reduction of the diameter of the curvature portion 42. For example, if the brake member 30 may be of material adapted to reduce the diameter by the elastic deformation or plastic deformation of itself, there is required no notch. The brake member 30 may be not provided over the full length of the hinge shaft 20 and may be partially provided.

Figure 10:
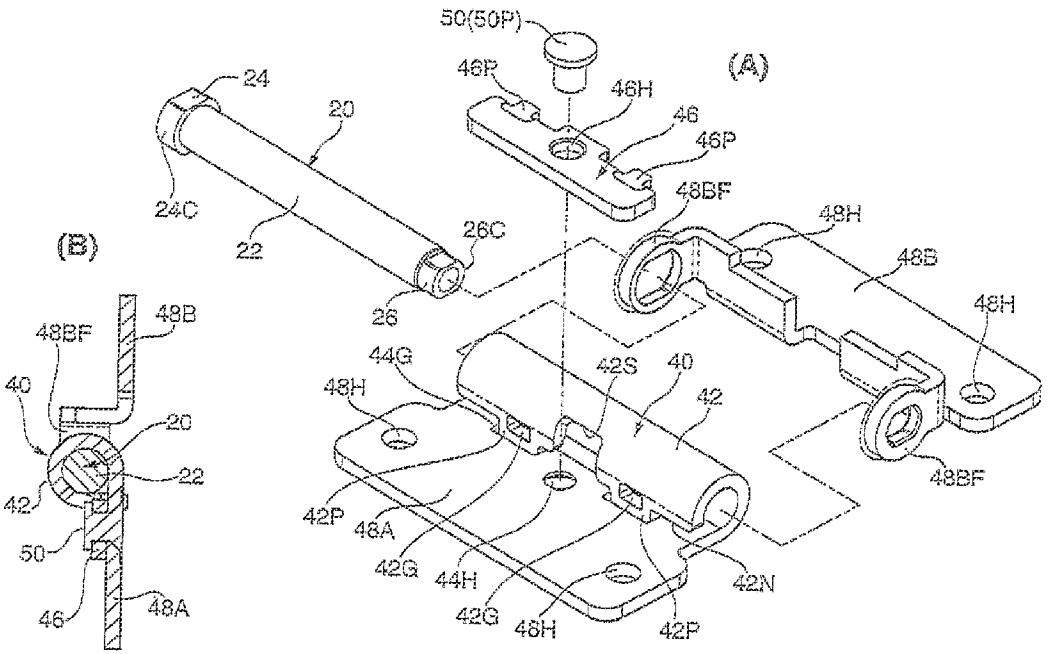

Although, in the forms of embodiment of FIGS. 1 through 9, the brake member 30 is formed between the curvature portion 42 of the holder 40 and the hinge shaft 20, the curvature portion 42 of the holder itself may serve as the brake member. FIG. 10 illustrates the hinge 10 with torque setting function of this form of embodiment. As shown in FIGS. 10(A) and (B), the inner face of the curvature portion 42 of the holder 40 directly engages the outer face of the hinge shaft 20 and the diameter of the curvature portion 42 is reduced by the same method as the forms of embodiment of FIGS. 1 through 9 whereby predetermined braking torque is imparted to the hinge shaft 20. Thus, the brake member 30 used in the forms of embodiment of FIGS. 1 through 9 is omitted. The curvature portion 42 of the holder 40 may just give braking torque to the hinge shaft 20 on the quality of the material of itself, and otherwise, there may be provided braking films such as plastic covering on the inside face of the curvature portion 42.

Although, in the aforementioned form of embodiment, the holder 40 reduces the diameter of curvature portion 42 on the one end side of the curvature portion 42, for example, the curvature portion 42 comprises an upper and lower half-divided segments. The lower half-divided segment of the curvature portion 42 may have two flat tightening portions integrally extending from the both sides of the lower half-divided segment of the curvature portion and two adjusting members are symmetrically disposed on and tightened to two flat tightening portions on both sides of the upper half-divided segment of the curvature portion, respectively whereby the upper half-divided segment of the curvature portion is tightened to thereby reduce the curvature portion.

POSSIBILITY OF UTILIZATION IN INDUSTRIES

According to the invention, since the diameter of the curvature portion of the holder to force the brake member against the hinge shaft is reduced by the adjusting member provided separately from the curvature portion, the tightening member such as the screw or the caulking pin can move vertically within the latch portion of the curvature portion individually from the angular movement of the curvature portion when it is tightened and therefore the screw or the caulking pin can tighten the curvature portion through the vertical movement thereof without being restrained by the angular movement of the curvature portion. Thus, the tightening of the holder can be made with high precision and effectiveness of the operation and the utilization in industries can be improved.

EXPLANATION OF REFERENCE NUMERALS

1 building Etc.
1W wall
1H window hole
1D door
2 case
2B body of case
2C lids
10 hinge with torque setting function
20 hinge shaft
22 body of shaft
24 and 26 partial square-shaped ends
24C and 26C cylindrical portions
24G and 26G square-shaped hole
30 brake member in the form of partially divided cylinder
32 and 34 two cylindrical portion divided in an axial direction
32N and 34N longitudinal notch
32F and 34F flanges
32P and 34P protrusion piece
40 holder
42 curvature portion
42G latch portion
42P insertion piece
42N notch
42S notch-like escape
44 flat tightening portion
44H tightening hole
44G insertion groove
46 adjusting member
46H tightening hole
46P protrusion piece
48A and 48B fastening board
48BF end flange
48H screw penetration hole
50 tightening member
50P tightening pin
50T screw
50N nut

The invention claimed is:

1. A hinge with torque setting function comprising: a hinge shaft having a fastening board fixed to said hinge shaft, said fastening board adapted to be securely attached to a first object; a brake member closely engaging said hinge shaft; and a holder adapted to be securely attached to a second object, said holder having said brake member secured thereto and holding said hinge shaft while forcing said brake member against said hinge shaft under predetermined pressure, said holder including a curvature portion to embrace said hinge shaft through said brake member and serving to tighten said curvature portion to said hinge shaft while reducing a diameter of said curvature portion, characterized in that said holder includes an adjusting member independent of said curvature portion to push a free end of said curvature portion to thereby reduce the diameter of said curvature portion and a tightening member to adjustably tighten and secure said adjusting member to a body of said holder, said adjusting member adapted to be tightened and secured to said body of said holder by said tightening member so as to be able to be moved without being restrained by a movement of said curvature portion when the diameter of said curvature portion is reduced.

2. A hinge with torque setting function as set forth in claim 1, wherein said body of said holder includes a flat tightening portion extending from another end of said curvature portion to be fixed to said second object and said adjusting member being adapted to be tightened to said flat tightening portion by said tightening member to thereby reduce the diameter of said curvature portion by being engaged with a latch portion provided on said free end of said curvature portion.

3. A hinge with torque setting function as set forth in claim 2 and wherein said free end of said curvature portion has at least one insertion piece inserted into a thrusting groove in said flat tightening portion.

4. A hinge with torque setting function as set forth in claim 3, and wherein said latch portion is provided on said insertion piece.

5. A hinge with torque setting function as set forth in claim 2, and wherein said flat tightening portion is a fastening board to be attached to said second object by a screw and the fastening board to be attached to said first object is to be attached by a screw to the first object and is attached to said hinge shaft so as to rotate together with said hinge shaft.

6. A hinge with torque setting function as set forth in claim 3, and wherein said flat tightening portion is a fastening board to be attached to said second object by a screw and the fastening board to be attached to said first object is to be attached by a screw to the first object and is attached to said hinge shaft so as to rotate together with said hinge shaft.

7. A hinge with torque setting function as set forth in claim 4, and wherein said flat tightening portion is a fastening board to be attached to said second object by a screw and another fastening board to be attached to said first object is to be attached by a screw to the first object and is attached to said hinge shaft so as to rotate together with said hinge shaft.

8. A hinge with torque setting function comprising: a hinge shaft having a fastening board fixed to said hinge shaft, said fastening board adapted to be securely attached to a first object and a holder including a curvature portion closely engaging said hinge shaft, said holder adapted to be securely attached to a second object and holding said hinge shaft while forcing said curvature portion against said hinge shaft under predetermined pressure, said holder serving to tighten said curvature portion to said hinge shaft while reducing a diameter of said curvature portion, characterized in that said holder includes an adjusting member independent of said curvature portion to push a free end of said curvature portion to thereby reduce the diameter of said curvature portion and a tightening member to adjustably tighten and secure said adjusting member to a body of said holder, said adjusting member adapted to be tightened and secured to said body of said holder by said tightening member so as to be able to be moved without being restrained by a movement of said curvature portion when the diameter of said curvature portion is reduced.

9. A hinge with torque setting function as set forth in claim 8, wherein said body of said holder includes a flat tightening portion extending from an end of said curvature portion to be fixed to said second object and said adjusting member being adapted to be tightened to said flat tightening portion by said tightening member to thereby reduce the diameter of said curvature portion by being engaged with a latch portion provided on said free end of said curvature portion.

* * * * *